US006441789B1

(12) United States Patent
Sasano

(10) Patent No.: US 6,441,789 B1
(45) Date of Patent: Aug. 27, 2002

(54) ANTENNA

(76) Inventor: Kouji Sasano, 3-13-18, Ichiba, Funabashi-shi, Chiba (JP)

( * ) Notice: Subject to any disclaimer, the term of this patent is extended or adjusted under 35 U.S.C. 154(b) by 0 days.

(21) Appl. No.: 09/807,883

(22) PCT Filed: Oct. 29, 1999

(86) PCT No.: PCT/JP99/06009

§ 371 (c)(1),
(2), (4) Date: Apr. 18, 2001

(87) PCT Pub. No.: WO00/26987

PCT Pub. Date: May 11, 2000

(30) Foreign Application Priority Data

Oct. 29, 1998 (JP) ..... 10-324534
Sep. 14, 1999 (JP) ..... 11-260715

(51) Int. Cl.[7] ..... H01Q 1/24
(52) U.S. Cl. ..... 343/702; 343/901
(58) Field of Search ..... 343/702, 901, 343/715, 900, 725, 729; 455/90

(56) References Cited

U.S. PATENT DOCUMENTS 5,245,350 A * 9/1993 Sroka ..... 343/702
5,302,963 A 4/1994 Wiggenhorn ..... 343/901
5,389,938 A * 2/1995 Harrison ..... 343/702

FOREIGN PATENT DOCUMENTS

| | | |
|---|---|---|
| JP | 4-318701 | 11/1992 |
| JP | 7-111414 | 4/1995 |
| JP | 10-163736 | 6/1998 |

* cited by examiner

*Primary Examiner*—Don Wong
*Assistant Examiner*—James Clinger
(74) *Attorney, Agent, or Firm*—Antonio R. Durando; Durando Birdwell & Janke, PLC

(57) ABSTRACT

A retractable antenna for mobile devices exhibits a high gain regardless of whether it is extended or retracted in the device. A λ/4 antenna element is retractably housed in a metal tube λ/4 long. A switching mechanism is provided so that the radio frequency power feed condition varies according to whether the λ/4 antenna element is extended or is retracted in the tube. The metal tube of length λ/4 is fed the radio frequency power of polarity opposite to that of the antenna element when the antenna element is extended, so that the tube and the antenna element function together as a dipole antenna. When the antenna is retracted into the tube, the radio frequency power is not fed to the antenna element, and the metal tube functions as a λ/4 antenna element.

14 Claims, 10 Drawing Sheets

ANTENNA

FIELD OF THE INVENTION

The present invention relates to an antenna used for portable devices, such as cell phones.

BACKGROUND ART

In recent years, portable devices such as cell phones have been widely diffused. These devices are now designed in more and more compact size. In association with this trend, antennas used for such devices are also designed in compact size, so that the antennas can be retracted in the case of the device.

A λ/4 monopole antenna is commonly used with portable devices. The antenna of portable devices is extended from the case to secure a high gain when it is being used. The antenna is usually retracted in the case when the device is not in use so that it does not bother the user. Even when it is not in use and the antenna is held in the case, the user must be always ready to respond to calls. In this respect, the antenna must have such a gain that an ID can be transmitted and a call signal can be received.

FIG. 1 shows cross-sectional views of a conventional type mobile device provided with a λ/4 monopole antenna. FIG. 1(*a*) shows the condition when the antenna is extended, and FIG. 1(*b*) shows the condition when the antenna is retracted in the case of the device.

In these figures, reference numeral 1 represents a case of a portable device; 2 a λ/4 antenna element; 3 a knob made of conductive or insulating material; 4 an RF power feed connection; 5 an insulating tube; and 6 a radio frequency (RF) power source or a tuner.

The antenna of the portable device is switched over to connect to the RF power source or the tuner. For simplicity, the invention is not also described below, for all embodiments, with reference to a connection to a tuner.

When the portable device is in operation, an RF power source 6 is always connected to the RF power feed connection 4. The antenna element 2 is designed in such manner that it can be extended from or retracted into the case 1 of the portable device while it is kept in contact with the RF power feed connection 4, and it is constantly connected to the RF power source 6 via the RF power feed connection 4.

When the portable device is used, the antenna element 2 is extended from the insulating tube 5 in the case, as shown in FIG. 1(*a*). When the device is not in use, the antenna element 2 is retracted and accommodated in the insulating tube 5 in the case, as shown in FIG. 1(*b*). In both the extended condition shown in FIG. 1(*a*) and the retracted condition shown in FIG. 1(*b*), the antenna element 2 works as a λ/4 monopole antenna.

The conventional type λ/4 monopole antenna, as described above, works as a λ/4 monopole antenna regardless of whether it is in the extended condition or in the retracted condition. As a result, it does not always have a sufficiently high gain, which is an important performance characteristic for mobile devices.

BRIEF DESCRIPTION OF THE DRAWINGS

FIG. 1(*a*) shows the condition when the antenna is extended, and FIG. 1(*b*) shows the condition when the antenna is retracted into a case.

FIG. 2(*a*) shows the condition when the antenna is extended; FIG. 2(*b*) shows the condition when the antenna is retracted in the case; and FIG. 2(*c*) shows a cross-sectional structure of the antenna body.

FIG. 3(*a*) shows the condition when the antenna is extended; FIG. 3(*b*) shows the condition when it is retracted in its case; and FIG. 3(*c*) shows a cross-sectional structure of the antenna body.

FIG. 4(*a*) shows the condition when the antenna is extended; FIG. 4(*b*) shows the condition when it is retracted in its case; and FIG. 4(*c*) shows a cross-sectional structure of the antenna body.

FIG. 5(*a*) shows the condition when the antenna is extended; FIG. 5(*b*) shows the condition when it is retracted in the case; and FIG. 5(*c*) shows a cross-sectional structure of the antenna body.

FIG. 6(*a*) shows the condition when the antenna is extended; FIG. 6(*b*) shows the condition when it is retracted in the case; and FIG. 6(*c*) shows a cross-sectional structure of the antenna body.

FIG. 7(*a*) shows the condition when the antenna is extended; FIG. 7(*b*) shows the condition when it is retracted in the case; and FIG. 7(*c*) shows a cross-sectional structure of the antenna body.

FIG. 8(*a*) is an enlarged front view of a portion A and a portion B of the Spertop antenna shown in FIG. 7(*a*). FIG. 8(*b*) shows an enlarged front view of a portion C and a portion D of the Spertop antenna shown in FIG. 7(*b*).

FIG. 9(*a*) shows the condition when the antenna is extended; FIG. 9(*b*) shows the condition when it is retracted in the case; and FIG. 9(*c*) shows a cross-sectional structure of the antenna body.

FIG. 10(*a*) shows an enlarged front view of a portion A and a portion B of the Brown antenna shown in FIG. 9(*a*), and FIG. 10(*b*) shows an enlarged front view of a portion C and a portion D of the Brown antenna shown in FIG. 9(*b*).

SUMMARY OF THE INVENTION

The present invention is characterized in that a conventional type λ/4 monopole antenna not having sufficient gain works as a λ/4 monopole antenna when the antenna is retracted in a case, and it works as a λ/2 dipole antenna when the antenna is extended.

When the antenna is extended, RF power is fed through balanced-to-unbalanced transformation from a coaxial cable at the central portion of two sets of λ/4 monopole antennas arranged in opposite directions on an approximately coaxial line. Specifically, the RF power has a current distribution with maximum amplitude at the RF power feed point, and the current phases of the two sets of λ/4 monopole antennas are inverted by 180° from each other. These antennas, therefore, work as a λ/2 dipole antenna, as seen from the coaxial cable.

BEST MODE FOR CARRYING OUT THE INVENTION

A description will be given below of embodiments of the present invention referring to the accompanying drawings.

Figure 1A:
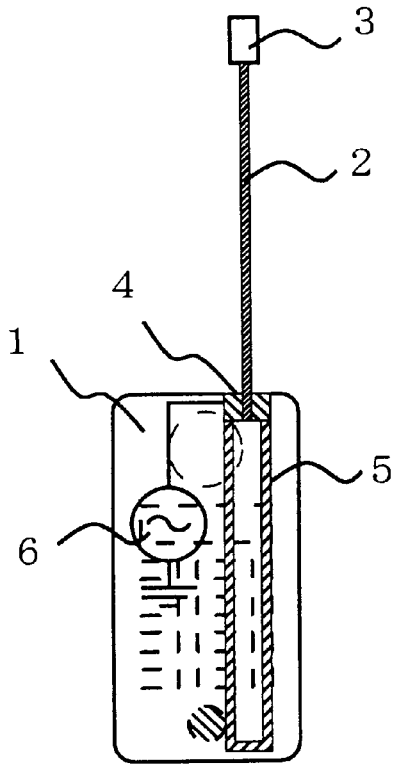
Fig. 1(a) (PRIOR ART)
FIG. 1 shows front sectional views of a conventional example.
Figure 1B:
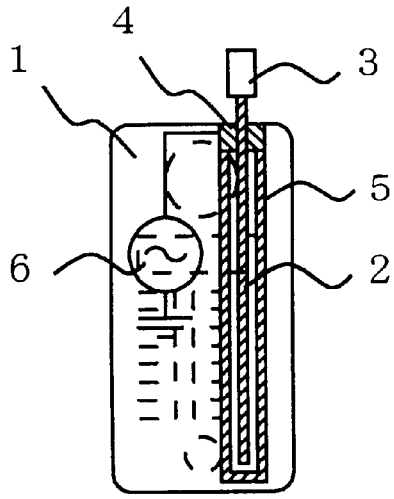
Fig. 1(b) (PRIOR ART)
Figure 2A:
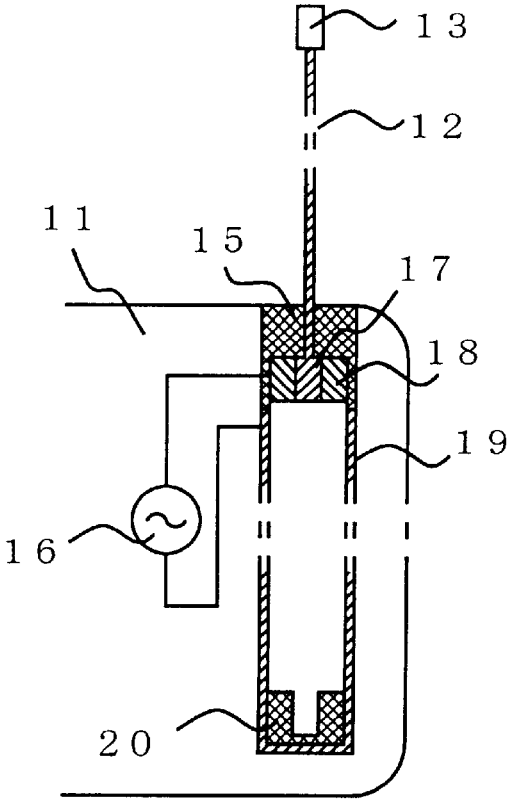
FIG. 2 shows sectional views of a dipole antenna according to a first embodiment of the present invention.
Figure 2B:
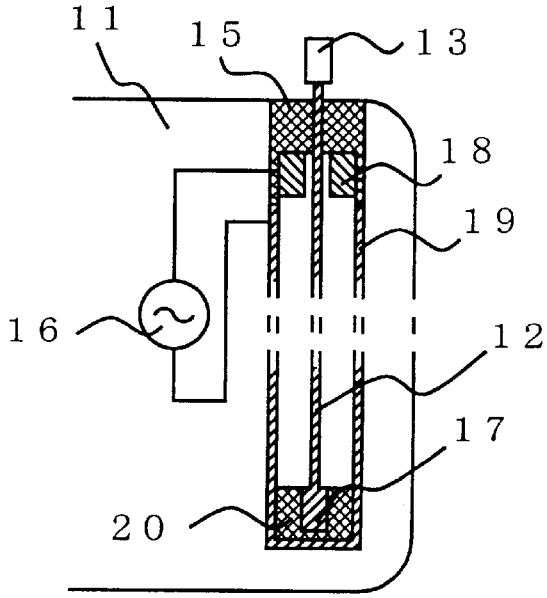
Figure 2C:
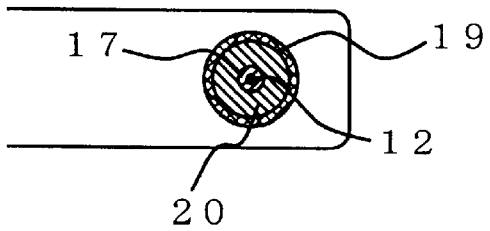

FIG. 2 represents cross-sectional views of a first embodiment of a portable device with a dipole antenna according to the present invention. FIG. 2(*a*) shows the condition when the antenna is extended; FIG. 2(*b*) shows the condition when the antenna is retracted in the device; and FIG. 2(*c*) shows a cross-sectional view of the antenna body.

In these figures, the reference numeral 11 represents the case for the portable device; 12 is a λ/4 antenna element adapted for insertion into the portable-device case 11; 13 is a knob made of a conductive or an insulating material; 16 is an RF power source; 17 is the base of the antenna element; 18 is an RF power feed conductor; 19 is a λ/4 conductive structure of cylindrical shape; 15 is a first insulator arranged at the upper end of the conductive structure, designed in cylindrical shape with a central hole adapted to slidably support the antenna element 12; and 20 is a second insulator arranged at the lower end of the conductive structure 19, designed in cylindrical shape with a central hole adapted to receive the lower end of the antenna element 12.

One side of the RF power source 16 is connected to the RF power feed conductor 18, and the other side is connected to the upper end of the conductive structure 19.

In the condition with the antenna extended, as shown in FIG. 2(*a*), one polarity of the RF power is fed to the antenna element base 17 via the RF power feed conductor 18, and the other polarity of the RF power is fed to the upper end of the conductive structure 19.

The antenna element 12, which is fed RF power of one polarity at its base 17, cooperates with the conductive structure 19, which is fed RF power of the other polarity at its upper end, to function as a λ/2 dipole antenna.

When the antenna is retracted in the case of the device, as shown in FIG. 2(*b*), the base of the antenna element 12 is moved away from the RF power feed conductor 18 and is disconnected from one side of the RF power source 16, while the other side of the RF power source remains connected to the upper end of the conductive structure 19.

Thus, the conductive structure 19 with the RF power fed to its upper end works as a λ/4 monopole antenna, but the antenna element 12, disconnected from one pole of the RF power source 16, does not work as an antenna.

Figure 3A:
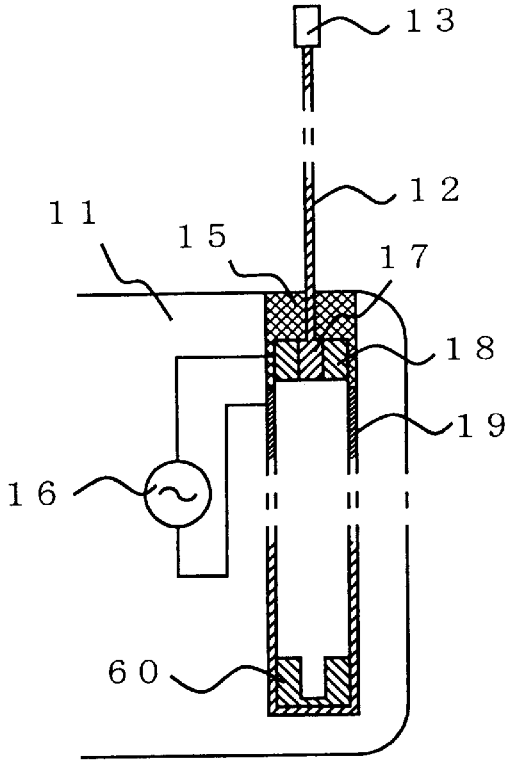
FIG. 3 shows cross-sectional views of a dipole antenna with another structure, which is a second embodiment of the present invention.
Figure 3B:
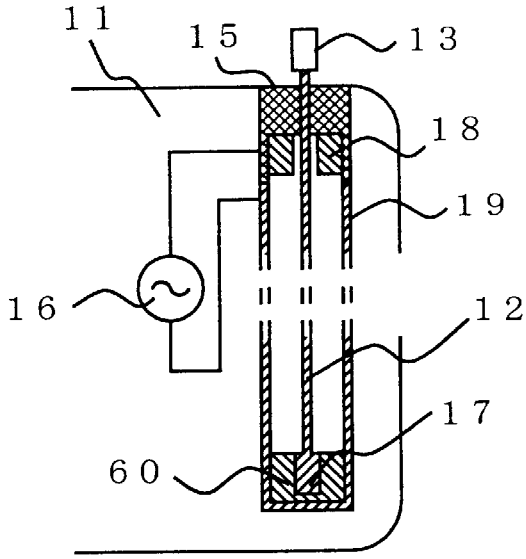
Figure 3C:
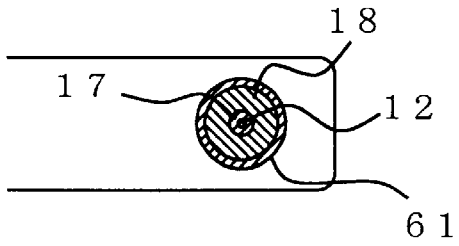

FIG. 3 shows cross-sectional views of a portable device according to a second embodiment, which is a variation of the first embodiment. FIG. 3(*a*) shows the condition when the antenna is extended; FIG. 3(*b*) shows the condition when the antenna is retracted in the device; and FIG. 3(*c*) is a cross-sectional view of the antenna body.

In these figures, the reference numeral 11 represents the case of the portable device; 12 is a λ/4 antenna element retractably connected to the case 11; 13 is a knob made of a conductive or an insulating material; 16 is an RF power source; 17 is an antenna element base; 18 is an RF power feed conductor; 19 is a λ/4 conductive structure of cylindrical shape; 15 is an insulator arranged at the upper end of the conductive structure, designed in cylindrical shape with a central hole adapted to slidably support the antenna element 12; and 60 is a conductor arranged at the lower end of the conductive structure 19, designed in cylindrical shape with a central hole for connection with the lower base 17 of the antenna element 12.

One side of the RF power source 16 is connected to the RF power feed conductor 18, and the other side is connected to the upper end of the conductive structure 19.

In the condition with the antenna extended, as shown in FIG. 3(*a*), one polarity of the RF power is fed to the antenna element base 17 via the RF power feed conductor 18, and the other polarity of the RF power is fed to the upper end of the conductive structure 19.

The antenna element 12, which is fed RF power of one polarity at its base 17, accordingly cooperates with the conductive structure 19, which is fed RF power of the other polarity at its upper end, and together they function as a λ/2 dipole antenna.

In the condition with the antenna retracted within the device, as shown in FIG. 3(*b*), the antenna element base 17 is connected via the conductor 60 to a point with the highest voltage of the conductive structure 19, which functions as a λ/4 monopole antenna; accordingly, the antenna works, as does the conductive structure 19, as a λ/4 monopole antenna.

Figure 4A:
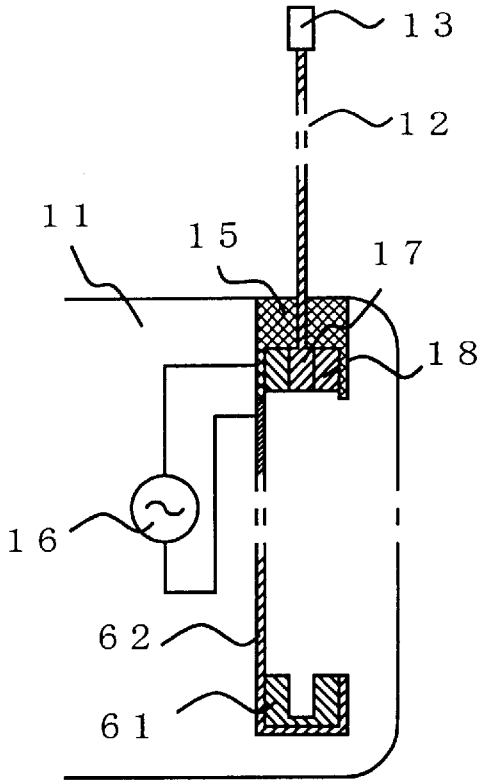
FIG. 4 shows cross-sectional views of a dipole antenna having a different structure, which is a third embodiment of the present invention.
Figure 4B:
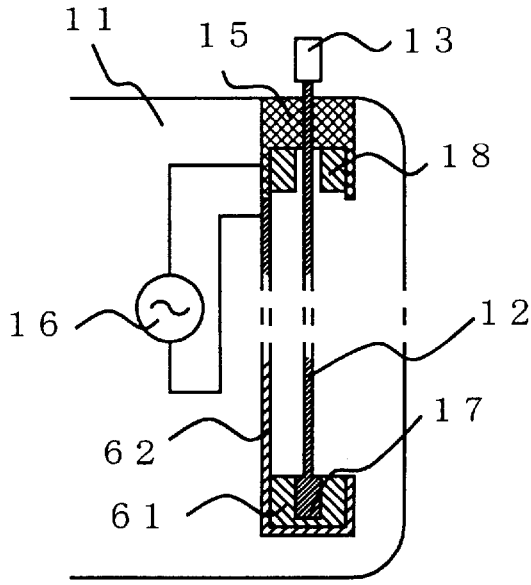
Figure 4C:
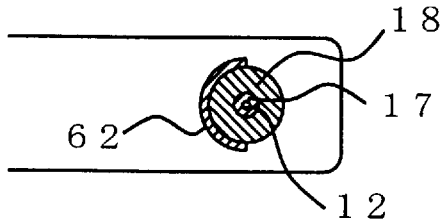

FIG. 4 shows cross-sectional views of a portable device according to a third embodiment, which is a variation of the first and the second embodiments. FIG. 4(*a*) shows the condition when the antenna is extended; FIG. 4(*b*) shows the condition when the antenna is retracted in the device; and FIG. 4(*c*) is a cross-sectional view of the antenna body.

In these figures, reference numeral 11 represents the case of the portable device; 12 is a λ/4 antenna element retractably connected to the portable-device case 11; 13 is a knob made of a conductive or an insulating material; 16 is an RF power source; 17 is an antenna element base; 18 is an RF power feed conductor; 62 is a λ/4 conductive structure of semi-cylindrical shape; 15 is an insulator arranged at the upper end of the conductive structure, designed in cylindrical shape with a central hole adapted to slidably support the antenna element 12; and 61 is a conductor arranged at the lower end of the conductive structure 62, designed in cylindrical shape with a central hole adapted for connection to the lower base 17 of the antenna element 12.

One side of the RF power source 16 is connected to the RF power feed conductor 18, and the other side is connected to the upper end of the conductive structure 62.

In the condition with the antenna extended, as shown in FIG. 4(*a*), one polarity of the RF power is fed to the antenna element base 17 via the RF power feed conductor 18, and the other polarity of the RF power is fed to the upper end of the conductive structure 62 of semi-cylindrical shape.

The antenna element 12, which is fed the RF power of one polarity at its base 17, accordingly, cooperates with the conductive structure 62 of semi-cylindrical shape, which is fed the RF power of the other polarity at its upper end, and together they function as a λ/2 dipole antenna.

In the condition with the antenna retracted in the device, as shown in FIG. 4(*b*), the antenna element base 17 is connected via the conductor 61 to a point with the highest voltage of the conductive structure 62 of semi-cylindrical shape, which functions as a λ/4 monopole antenna; accordingly, the antenna works, as the conductor 62 of semi-cylindrical shape, as a λ/4 monopole antenna.

It is also possible to use an insulating material instead of the conductor 61. In such a case, when the antenna element base 17 is moved away from the RF power feed conductor 18 and is separated from one pole of the RF power 16, the antenna element 12 does not work as an antenna, and only the conductive structure 62 of semi-cylindrical shape, which is fed the RF power of the other polarity, works as a λ/4 monopole antenna.

Figure 5A:
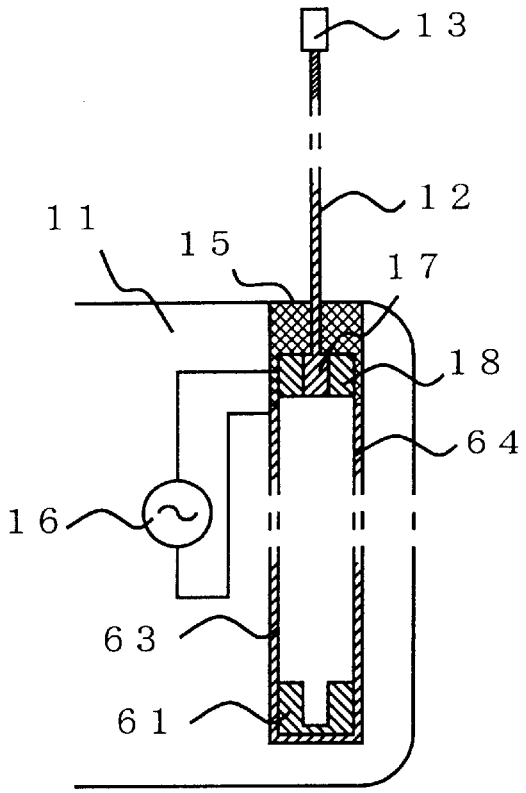
FIG. 5 shows cross-sectional views of a dipole antenna having still a different structure, which is a fourth embodiment of the present invention.
Figure 5B:
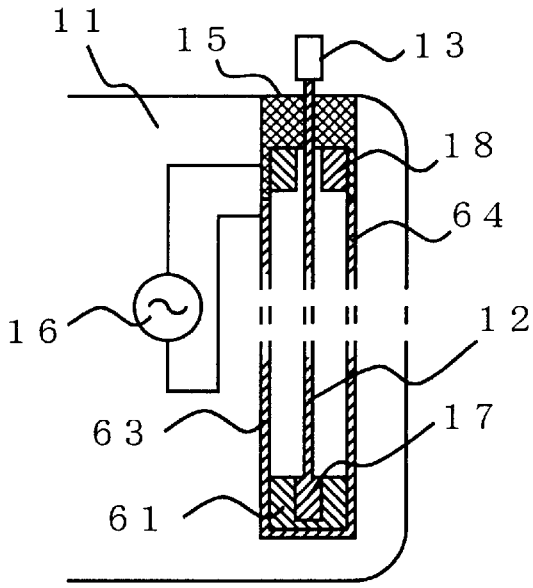
Figure 5C:
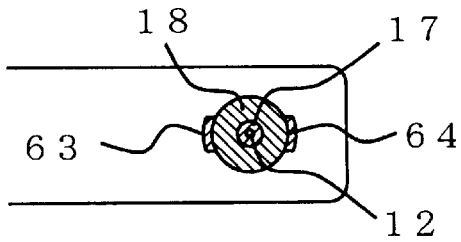

FIG. 5 shows cross-sectional views of a portable device according to a fourth embodiment, which is a variation of the first and the second embodiments. FIG. 5(*a*) shows the condition when the antenna is extended; FIG. 5(*b*) shows the condition when the antenna is retracted within the device; and FIG. 5(*c*) is a cross-sectional view of the antenna body.

In these figures, reference numeral 11 represents the case of the portable device; 12 is a λ/4 antenna element to be retracted into the portable-device case 11; 13 is a knob made of a conductive or an insulating material; 16 is an RF power source; 17 is an antenna element base; 18 is an RF power feed conductor; each of 63 and 64 refer to a conductive plate disposed in parallel to the antenna element when it is retracted in the device and designed in partially cylindrical shape with length of λ/4 such as to constitute a conductive structure; 15 is an insulator positioned at the upper end of the conductive structure, designed in cylindrical shape with a central hole adapted to slidably support the antenna element 12; and 61 is a conductor placed at the lower end of the conductive plates 63, 64, designed in cylindrical shape with a central hole for connection with the lower base of the antenna element 12.

One side of the RF power source 16 is connected to the RF power feed conductor 18, and the other side is connected to the upper ends of the two partially cylindrical conductive plates 63 and 64.

In the condition with the antenna extended, as shown in FIG. 5(*a*), one polarity of the RF power is fed to the antenna element base 17 via the RF power feed conductor 18, and the other polarity of the RF power is fed to the upper ends of the two partially cylindrical conductive plates 63 and 64.

The antenna element 12, which is fed the RF power of one polarity at its base 17, accordingly cooperates with the two partially cylindrical conductive plates 63 and 64, which are fed the RF power of the other polarity at their upper ends, and together they function as a λ/2 dipole antenna.

In the condition with the antenna retracted in the device, as shown in FIG. 5(*b*), the antenna element base 17 is connected via the conductor 61 to a point with the highest voltage on the two conductive plates 63 and 64, which work as a λ/4 monopole antenna; accordingly, the antenna works, like the two conductive plates 63 and 64, as a λ/4 monopole antenna.

It is also possible to use an insulating material instead of the conductor 61. In such a case, when the antenna element base 17 is moved away from the RF power feed conductor 18 and is separated from one pole of the RF power source 16, the antenna element 12 does not work as an antenna, and only the two conductive plates 63 and 64, which are fed the RF power of the other polarity, function as a λ/4 monopole antenna.

Figure 6A:
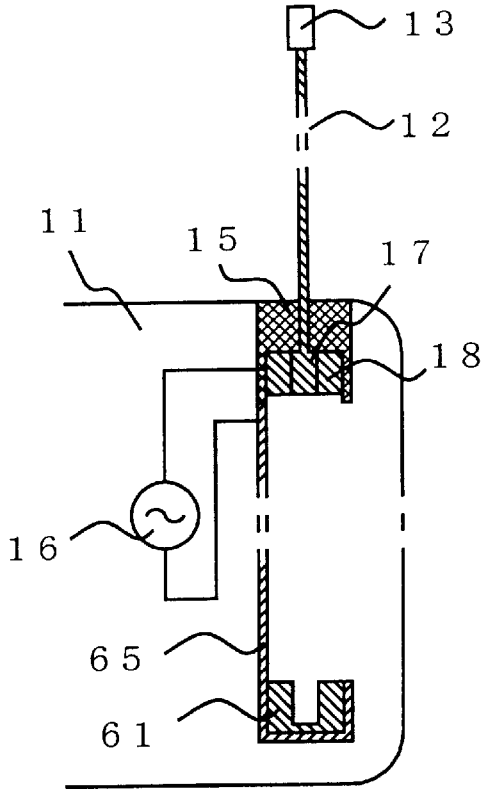
FIG. 6 represents cross-sectional views of a dipole antenna having yet a different structure, which is a fifth embodiment of the present invention.
Figure 6B:
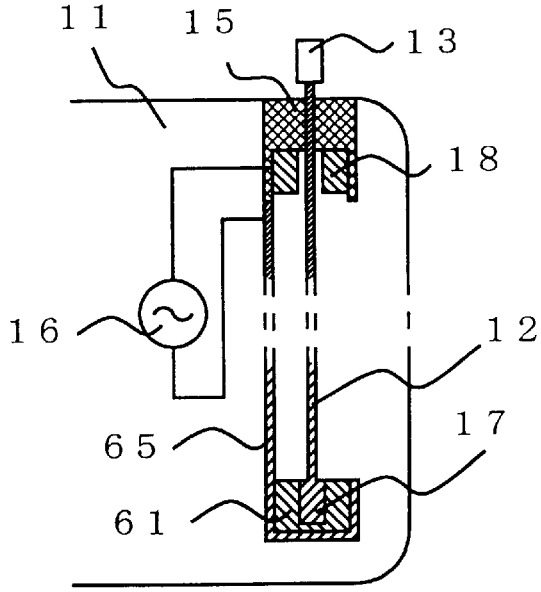
Figure 6C:
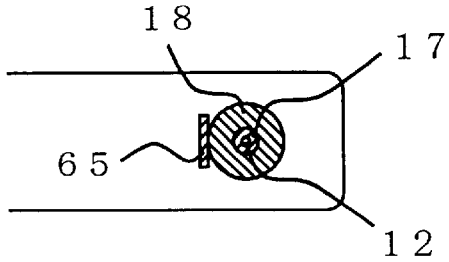

FIG. 6 shows cross-sectional views of a portable device according to a fifth embodiment, which is a variation of the first and the second embodiments. FIG. 6(*a*) shows the condition when the antenna is extended; FIG. 6(*b*) shows the condition when the antenna is retracted in the device; and FIG. 6(*c*) is a cross-sectional view of the antenna body.

In these figures, reference numeral 11 represents the case of the portable device; 12 is a λ/4 antenna element; 13 is a knob made of a conductive or an insulating material; 16 is an RF power source; 17 is an antenna element base; 18 is an RF power feed connection; 65 is a metal plate; 15 is an insulator to insulate the RF power feed connection 18 from the conductive plate 65; and 61 is a conductor to connect the antenna element base 17 to the conductive plate 65.

One side of the RF power source 16 is connected to the RF power feed connection 18, and the other side is connected to the upper end of the conductive plate 65.

In the condition with the antenna extended, as shown in FIG. 6(*a*), one polarity of the RF power is fed to the antenna element base 17 via the RF power feed connection 18, and the other polarity of the RF power is fed to the upper end of the conductive plate 65.

The antenna element 12, which is fed the RF power of one polarity at its base 17, accordingly cooperates with the conductive plate 65, which is fed the RF power of the other polarity at its upper end, and together they function as a λ/2 dipole antenna.

In the condition with the antenna retracted in the device, as shown in FIG. 6(*b*), the antenna element base 17 is connected via the conductor 61 to a point with the highest voltage of the conductive plate 65, which works as a λ/4 monopole antenna; accordingly, the antenna works, like the conductive plate 65, as a λ/4 monopole antenna.

It is also possible to use an insulator instead of the conductor 61. In such a case, when the antenna element base 17 is moved away from the RF power feed connection 18 and is separated from one pole of the RF power source 16, the antenna element 12 does not work as an antenna, and only the conductive plate 65, which is fed the RF power of the other polarity works, as a λ/4 monopole antenna.

The conductive plate 65 may be, instead of an independently supported metal plate, a conductive pattern on printed board incorporated in the portable device or formed on an insulating case, which may provide a simpler arrangement.

Figure 7A:
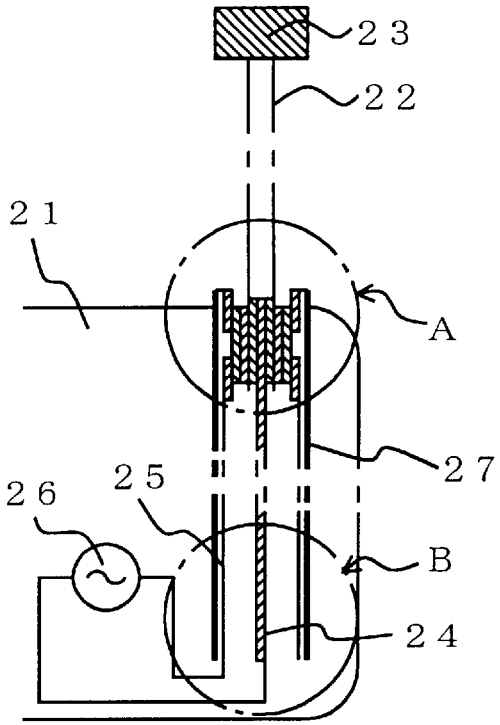
FIG. 7 represents cross-sectional views of a Spertop antenna, which is a sixth embodiment of the present invention.
Figure 7B:
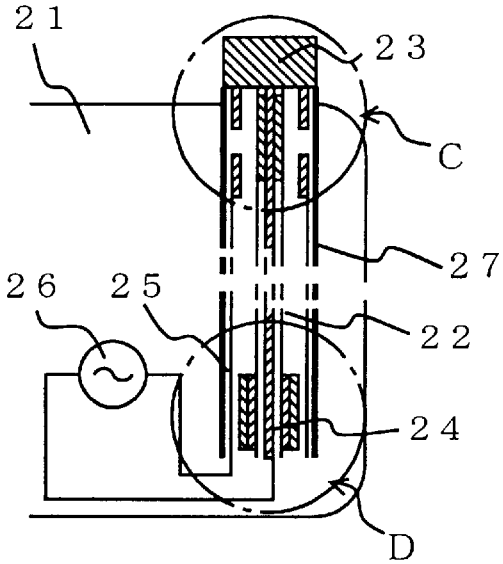
Figure 7C:
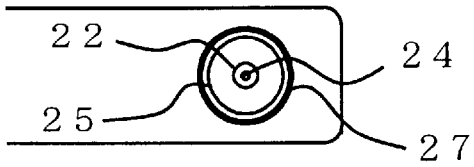

FIG. 7 shows cross-sectional views of a portable device according to a sixth embodiment, in which the present invention is applied to a Spertop antenna. FIG. 7(*a*) shows the condition with the antenna extended; FIG. 7(*b*) shows the condition with the antenna retracted in the device; and FIG. 7(*c*) is a cross-sectional view of the antenna body.

Figure 8A:
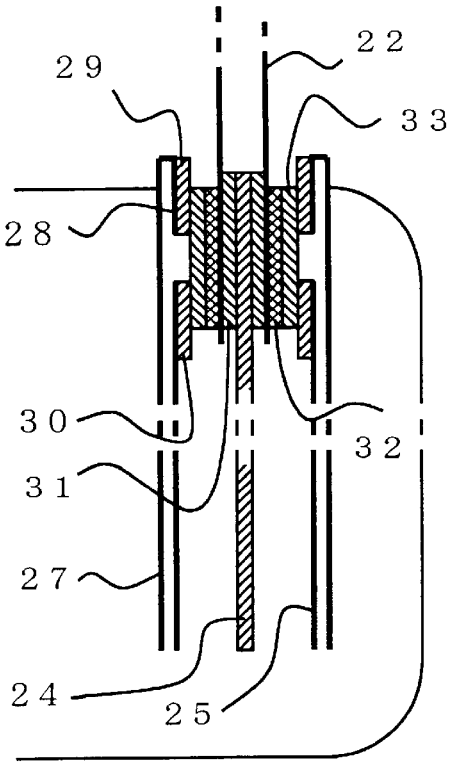
FIG. 8 shows partially enlarged views of the Spertop antenna shown in FIG. 7.
Figure 8B:
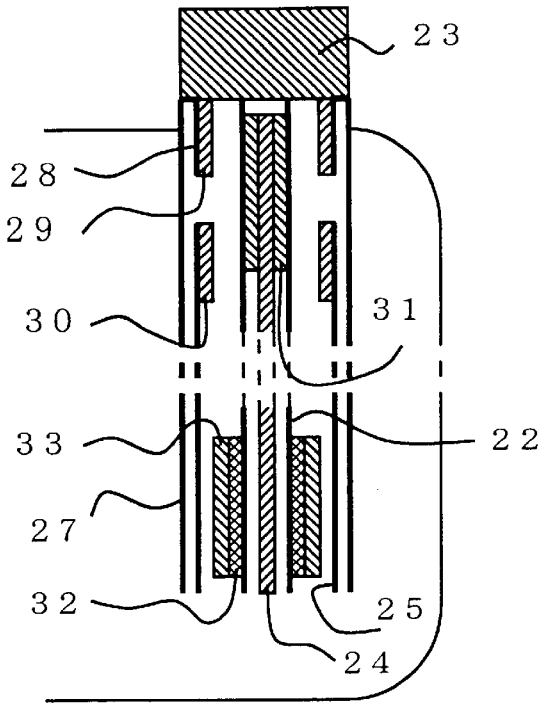

FIG. 8 shows partially enlarged views of the Spertop antenna shown in FIG. 7. FIG. 8(*a*) is an enlarged front view of the portion A and the portion B shown in FIG. 7(*a*), and FIG. 8(*b*) is an enlarged front view of the portion C and the portion D shown in FIG. 7(*b*).

In these figures, reference numeral 21 represents the case of the portable device; 22 is a λ/4 antenna element comprising a conductive tube; 23 is a knob made of a conductive material; 24 is the internal conductor of a coaxial RF power feeder; 25 is the external conductor of the coaxial RF power feeder; 26 is an RF power source; 27 is a λ/4 conductive outer tube (Spertop); 28 is an outer tube conductor; 29 is an outer tube contact; 30 is an RF power source contact; 31 is an RF power feed connection; 32 is a sliding contact supporting insulator; and 33 is a sliding contact.

The RF power feed connection 31 is provided on the outer side of the upper end of the internal conductor 24 of the coaxial RF power feeder. The sliding contact 33 is provided via the sliding contact supporting insulator 32 on outer side of the lower end of the tubular antenna element 22.

The knob 23 made of conductive material is electrically connected to the antenna element 22 and is adapted for electrical connection with the outer tube conductor 28 when the antenna is retracted into the device.

The RF power contact 30 is provided on the inner side of the upper end of the external conductor of the coaxial RF power feeder.

The outer tube conductor 28 has the same diameter as the external conductor 25 of the coaxial RF power feeder and is positioned on an extension of the external conductor 25, but it is separated from the external conductor 25 and includes an outer tube contact 29 on its inner side.

One side of the RF power source 26 is connected to the internal conductor 24 of the coaxial RF power feeder, and the other side is connected to the external conductor 25 of the coaxial RF power feeder.

In the condition with the antenna extended, as shown in FIG. 7(*a*) and FIG. 8(*a*), the RF power feed connection 31 of the antenna element 22 is connected to the internal conductor 24 of the coaxial RF power feeder, and the RF power source contact 30 and the outer tube contact 29 are connected via the sliding contact 33.

As a result, one polarity of the RF power is fed to the antenna element 22 via the internal conductor 24 of the coaxial RF power feeder and the RF power feed connection 31, and the other polarity of the RF power is fed to the conductive outer tube 27 via the external conductor 25 of the coaxial RF power feeder, the RF power source contact 30, the sliding contact 33, the outer tube contact 29, and the outer tube conductor 28.

Thus, the antenna element 22, which is fed the RF power of one polarity via the RF power feed connection 31, and the conductive outer tube 27, which is fed the RF power of the other polarity via the conductor 28 on the outer tube, work as a Spertop; accordingly, they provide a Spertop antenna structure.

In the condition with the antenna retracted in the device, as shown in FIG. 7(*b*) and FIG. 8(*b*), the antenna element 22 is connected to the internal conductor 24 of the coaxial RF power feeder via the RF power feed connection 31. The sliding contact 33 provided on the outer side of the lower end of the antenna element 22 is moved downward by the antenna element 22 being retracted into the device and, accordingly, the connection between the RF power contact 30 and the outer tube contact 29 is cut off.

Further, the knob 23 electrically connected with the antenna element 22 is connected to the outer tube conductor 28.

As a result, one polarity of the RF power is fed to the outer tube 27 via the internal conductor 24 of the coaxial RF power feeder, the RF power feed connection 31, the knob 23, and the outer tube conductor 28; thus, the outer tube 27 functions as a $\lambda/4$ monopole antenna.

In the above embodiment, the description has been given on the assumption that the RF power feed connection 31 is provided on the outer side of the upper end of the internal conductor 24 of the coaxial RF power feeder, while the RF power feed connection 31 may be provided equivalently on the outer side of the lower end of the antenna element 22.

Figure 9A:
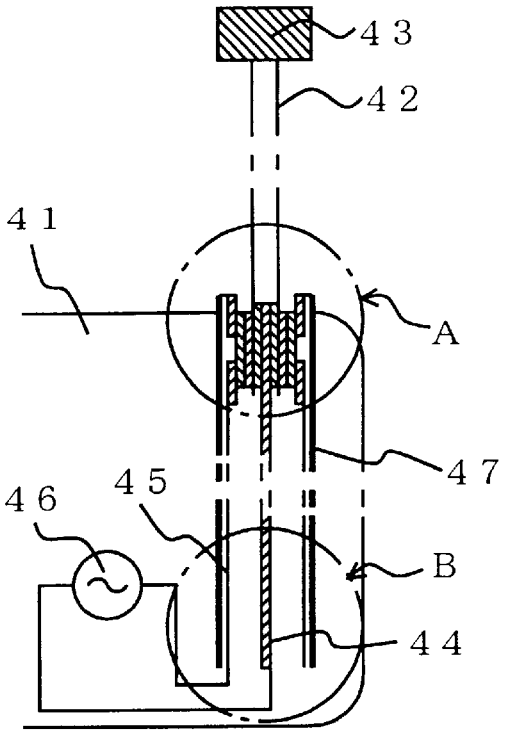
FIG. 9 shows cross-sectional views of a Brown antenna.
Figure 9B:
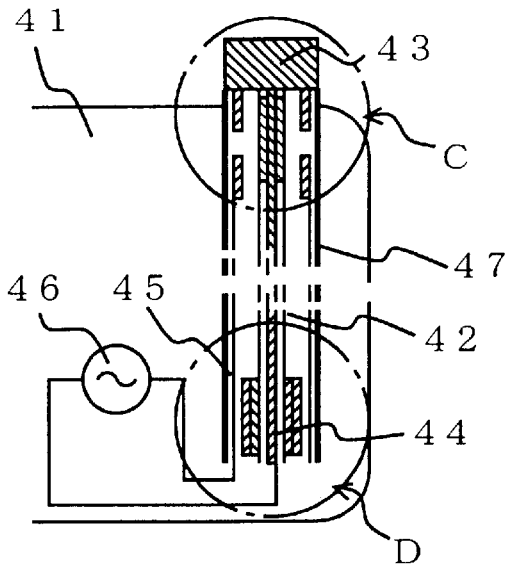
Figure 9C:
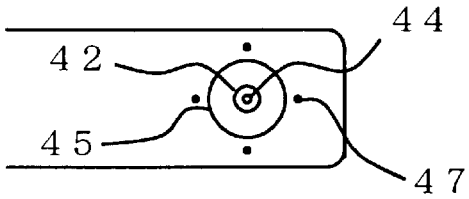

FIG. 9 shows cross-sectional views of a portable device according to a seventh embodiment, where the present invention is applied to a Brown antenna. FIG. 9(*a*) shows the condition with the antenna extended; FIG. 9(*b*) shows the condition with the antenna retracted in the device; and FIG. 9(*c*) is a cross-sectional view of the antenna body.

Figure 10A:
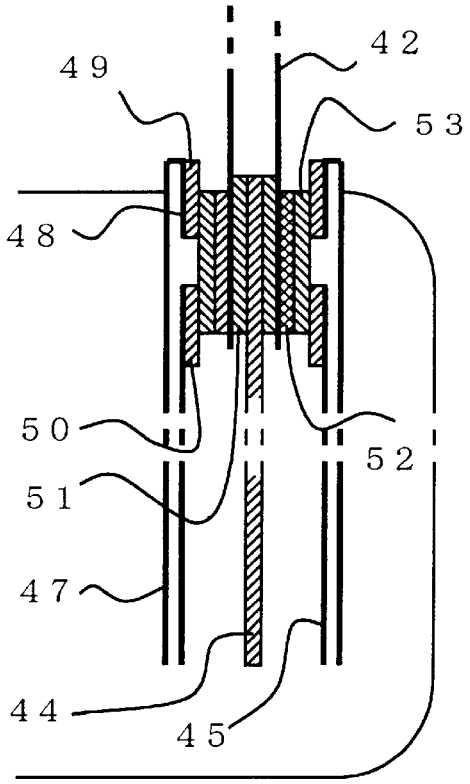
FIG. 10 shows partially enlarged views of the Brown antenna shown in FIG. 9.
Figure 10B:
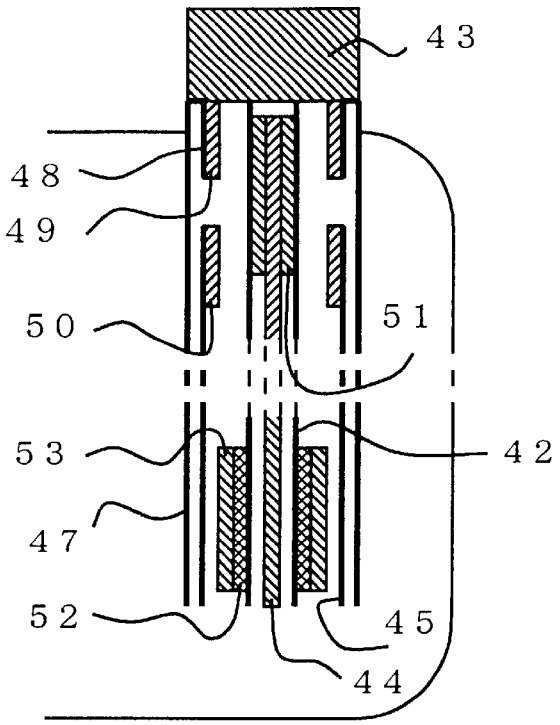

FIG. 10 shows partially enlarged views of the Brown antenna shown in FIG. 9. FIG. 10(*a*) is an enlarged front view of the portion A and the portion B shown in FIG. 9(*a*), and FIG. 10(*b*) is an enlarged front view of the portion C and the portion D of FIG. 9(*b*).

In these figures, reference numeral 41 represents the case of a portable device; 42 is a $\lambda/4$ antenna element comprising a conductive tube; 43 is a knob made of a conductive material; 44 is the internal conductor of a coaxial RF power feeder; 45 is the external conductor of the coaxial RF power feeder; 46 is an RF power source; 47 is a $\lambda/4$ ground; 48 is a ground conductor; 49 is a ground contact; 50 is an RF power contact; 51 is an RF power feed connection; 52 is a sliding contact supporting insulator; and 53 is a sliding contact.

The RF power feed connection 51 is provided on the outer side of the upper end of the internal conductor 44 of the coaxial RF power feeder. The sliding contact 53 is provided on the outer side of the lower end of the cylindrical antenna element 42 via the sliding contact supporting insulator 52.

The knob 43 made of the conductive material is electrically connected with the antenna element 42 and is electrically connectable with the ground conductor 48 when the antenna is retracted in the device.

The RF power contact 50 is provided on the inner side of the upper end of the external conductor of the coaxial RF power feeder.

The ground conductor 48 has the same diameter as the external conductor 45 of the coaxial RF power feeder and is positioned on an extension of the external conductor 45, but it is separated from the external conductor 45 and it includes a ground contact 49 on its inner side.

One side of the RF power source 46 is connected to the internal conductor 44 of the coaxial RF power feeder, and the other side is connected to the external conductor 45 of the coaxial RF power feeder.

In the condition with the antenna extended, as shown in FIG. 9(*a*) and FIG. 10(*a*), the antenna element 42 is connected to the RF power feed connection 51 of the internal conductor 44 of the coaxial RF power feeder, and the RF power contact 50 and the ground contact 49 are connected via the sliding contact 53.

As a result, one polarity of the RF power is fed to the antenna element 42 via the internal conductor 44 of the coaxial RF power feeder and the RF power feed connection 51, and the other polarity of the RF power is fed to the conductive ground 47 via the external conductor 45 of the coaxial RF power feeder, the RF power contact 50, the sliding contact 53, the ground contact 49, and the ground conductor 48.

Thus, the RF power of one polarity is fed to the antenna element 42 via the RF power feed connection 51, while the RF power of the other polarity is fed to the conductive ground 47 via the ground conductor 48; accordingly, these provide a Brown antenna structure.

In the condition with the antenna retracted in the device, as shown in FIG. 9(*b*) and FIG. 10(*b*), the antenna element 42 is connected to the internal conductor 44 of the coaxial RF power feeder via the RF power feed connection 51. The sliding contact 53 provided on the outer side of the lower end of the antenna element 42 is moved by the antenna element 42 being retracted in the device; accordingly, the connection between the RF power contact 50 and the ground contact 49 is cut off.

Further, the knob 43 electrically connected with the antenna element 42 is connected to the ground conductor 48.

As a result, one polarity of the RF power is fed to the ground 47 via the internal conductor 44 of the coaxial RF power feeder, the RF power feed connection 51, the knob 43 and the ground conductor 48; thus, the ground 47 functions as a $\lambda/4$ monopole antenna.

In the above embodiment, the description has been based on the assumption that the RF power feed connection 51 is provided on the outer side of the upper end of the internal conductor 44 of the coaxial RF power feeder, but the RF power feed connection 51 may as well be provided on the outer side of the lower end of the antenna element 42.

INDUSTRIAL APPLICABILITY

In an antenna according to the present invention, RF power is fed through balanced-to-unbalanced transformation from a coaxial cable at the central portion of two sets of λ/4 monopole antennas, which are arranged in opposite directions on an approximately coaxial line when the antenna is extended. Specifically, the RF power has a current distribution with maximum amplitude at the RF power feed point, and the current phases of the two sets of λ/4 monopole antennas are inverted by 180° from each other. As a result, these antennas work as a λ/2 dipole antenna, as seen from the coaxial cable. Thus, it is possible to provide an antenna with sufficiently high gain for a portable device.

What is claimed is:

1. An antenna, comprising:

a λ/4 antenna element retractably coupled to a case of a portable device;

a conductive structure having a cylindrical shape and a length of λ/4 for coaxially housing said antenna element when the antenna element is retracted in the device;

a first insulator having a cylindrical shape with a first central hole for slidably supporting said antenna element in said first central hole, said first insulator being provided on an upper end of said conductive structure;

a second insulator having a cylindrical shape with a second central hole for connection with a lower end of said antenna element, said second insulator being provided on a lower end of said conductive structure; and a radio frequency power feed conductor of cylindrical shape with a third central hole, said radio frequency power feed conductor being connected to an inner side of said first cylindrical insulator in sliding contact with said antenna element through said first central hole, and being insulated from said conductive structure, whereby:

one pole of a radio frequency power is connected to said radio frequency power feed conductor; and another pole of the radio frequency power is connected to an upper end of said conductive structure.

2. An antenna, comprising:

a λ/4 antenna element retractably coupled to a case of a portable device;

a conductive structure having a cylindrical shape and a length of λ/4 for coaxially housing said antenna element when the antenna element is retracted in the device;

an insulator having a cylindrical shape with a first central hole for slidably supporting said antenna element in said first central hole, said insulator being provided on an upper end of said conductive structure;

a conductor having a cylindrical shape with a second central hole for connection with a lower end of said antenna element, said conductor being provided on a lower end of said conductive structure; and a radio frequency power feed conductor of cylindrical shape with a third central hole, said radio frequency power feed conductor being connected to an inner side of said insulator in sliding contact with said antenna element through said first central hole, and being insulated from said conductive structure, whereby:

one pole of the radio frequency power is connected to said radio frequency power feed conductor; and another pole of the radio frequency power is connected to an upper end of said conductive structure.

3. An antenna, comprising:

a λ/4 antenna element retractably coupled to a case of a portable device;

a conductive structure having a semi-cylindrical shape and a length of λ/4 for coaxially housing said antenna element when the antenna element is retracted in the device;

an insulator having a cylindrical shape with a first central hole for slidably supporting said antenna element in said first central hole, said insulator being provided on an upper end of said conductive structure;

a conductor having a cylindrical shape with a second central hole for connection with a lower end of said antenna element, said conductor being provided on a lower end of said conductive structure; and a radio frequency power feed conductor of cylindrical shape with a third central hole, said radio frequency power feed conductor being connected to an inner side of said insulator in sliding contact with said antenna element through said first central hole, and being insulated from said conductive structure, whereby:

one pole of the radio frequency power is connected to said radio frequency power feed conductor; and another pole of the radio frequency power is connected to an upper end of said conductive structure.

4. An antenna, comprising:

a λ/4 antenna element retractably coupled to a case of a portable device;

two conductive plates having a partially cylindrical shape and a length of λ/4, said plates being arranged in parallel to said antenna element when the antenna element is retracted in the device;

an insulator having a cylindrical shape with a first central hole for slidably supporting said antenna element in said first central hole, said insulator being provided on an upper end of said two conductive plates;

a conductor having a cylindrical shape with a second central hole for connection with a lower end of said antenna element, said conductor being provided on a lower end of said two conductive plates; and a radio frequency power feed conductor of cylindrical shape with a third central hole, said radio frequency power feed conductor being connected to an inner side of said insulator in sliding contact with said antenna element through said first central hole, and being insulated from said two conductive plates, whereby:

one pole of the radio frequency power is connected to said radio frequency power feed conductor; and another pole of the radio frequency power is connected to an upper end of said two conductive plates.

5. An antenna, comprising:

a λ/4 antenna element retractably coupled to a case of a portable device;

a conductive plate having a length of λ/4, said plate being arranged in parallel to said antenna element when the antenna element is retracted in the device;

an insulator having a cylindrical shape with a first central hole for slidably supporting said antenna element in said first central hole, said insulator being provided on an upper end of said conductive plate;

a conductor having a cylindrical shape with a second central hole for connection with a lower end of said antenna element, said conductor being provided on a lower end of said conductive plate; and a radio frequency power feed conductor of cylindrical shape with a third central hole, said radio frequency power feed conductor being connected to an inner side of said insulator in sliding contact with said antenna element through said first central hole, and being insulated from said conductive plate, whereby:

one pole of the radio frequency power is connected to said radio frequency power feed conductor; and another pole of the radio frequency power is connected to an upper end of said conductive plate.

6. An antenna according to claim 5, wherein said conductive plate is a metal plate.

7. An antenna according to claim 5, wherein said conductive plate is a conductive film.

8. An antenna comprising a cylindrical λ/4 antenna element disposed around an internal conductor of a coaxial radio frequency power feeder, and a cylindrical λ/4 outer tube disposed around an external conductor of said coaxial power feeder;

wherein a pole of a radio frequency power source is connected to a base of said antenna element via said internal conductor when the antenna element is extended; and wherein another pole of the radio frequency power source is connected to an upper end of said outer tube via said external conductor, such that radio frequency power is fed to said outer tube via said internal conductor from one end of the radio frequency power source when the antenna element is retracted in the device.

9. An antenna comprising a cylindrical λ/4 antenna element disposed around an internal conductor of a coaxial radio frequency power feeder, and a λ/4 ground disposed around an external conductor of said coaxial radio frequency power feeder;

wherein a pole of a radio frequency power source is connected to a base of said antenna element via said internal conductor and another pole of the radio frequency power source is connected to an upper end of said ground via said external conductor when the antenna element is extended; and wherein the radio frequency power is fed from a single pole of the radio frequency power source to said ground via said internal conductor when the antenna element is retracted in the device.

10. An antenna comprising:

a λ/4 antenna element retractably coupled to a portable device;

a conductive structure having a length of λ/4 and adapted for alignment with said antenna element when the antenna element is retracted in the device;

an insulating member for slidably supporting the antenna element in alignment with said conductive structure;

a first conductor member adapted for electrical connection with said antenna element when the antenna element is extended from the device;

a second conductor member electrically coupled to said conductive structure and adapted for electrical connection with said antenna element when the antenna element is retracted into the device; and a radio-frequency device with a first pole connected to said first conductor and a second pole connected to said conductive structure.

11. The antenna of claim 10, wherein said conductive structure includes a tube.

12. The antenna of claim 10, wherein said conductive structure includes a semi-cylindrical tube section.

13. The antenna of claim 10, wherein said conductive structure includes two partially cylindrical tube sections.

14. The antenna of claim 10, wherein said conductive structure includes a plate.

* * * * *